United States Patent [19]

Benson

[11] 4,441,301

[45] Apr. 10, 1984

[54] GARAGE DOOR PANEL APPARATUS AND METHOD

[75] Inventor: Henry E. Benson, Orlando, Fla.

[73] Assignee: Architectural Specialties Co., Inc., Orlando, Fla.

[21] Appl. No.: 413,149

[22] Filed: Aug. 30, 1982

[51] Int. Cl.[3] ..... E04B 2/28

[52] U.S. Cl. ..... 52/804; 52/309.11; 52/738; 49/488

[58] Field of Search ..... 52/804, 403, 309.9, 52/309.11; 49/DIG. 1, 478, 488, 493; 160/232

[56] References Cited

U.S. PATENT DOCUMENTS

| | | | |
|---|---|---|---|
| 3,289,352 | 12/1966 | Heilweil et al. | 49/478 |
| 3,367,076 | 2/1968 | O'Brien | 52/309.11 |
| 3,750,333 | 8/1973 | Vance | 49/488 |
| 4,183,393 | 1/1980 | Bailey | 52/309.9 |
| 4,305,230 | 12/1981 | Gerritsen | 49/478 |

*Primary Examiner*—Henry E. Raduazo

*Attorney, Agent, or Firm*—William M. Hobby, III

[57] ABSTRACT

A garage door panel apparatus is formed with a metal sheet and having an insulating barrier strip connecting the inner and outer metal sheets of each panel to block conduction of heat between the front and back metal sides. The barrier strip holds front and back sheets together and provides a support for the weatherstrip. The metal sheet is filled with a rigid polymer foam which acts as insulation and support for the metal sheet. The method provides for making of a garage door panel in which the metal sheet of the front and back panels are joined by a barrier strip which holds the sheets together in a spaced relationship to each other. The expansion of the polymer foam within the door panel metal sheet increases the pressure to lock the barrier strips onto the edges of the panel's metal sheet. Thus, the barrier strip locks the front and back metal sheets together while forming an insulator against the conduction of heat through the metal and simultaneously providing a support for weatherstripping.

7 Claims, 6 Drawing Figures

GARAGE DOOR PANEL APPARATUS AND METHOD

BACKGROUND OF THE INVENTION

The present invention relates to garage doors and especially to a garage door panel and a method of making a garage door panel having a barrier strip connecting the front and back metal sheets of the panel.

It has been common in the past to make overhead commercial and residential garage doors in a wide variety of materials, including wood or formed wood products, fiberglass and steel or aluminum doors. Metal doors utilize a relatively thin sheet or skin of metal on the front and back with a supporting and insulating material between the front and back. It has been common to fill a space between the front and back panels with a polymer foam, such as a polyurethane, from which may be a rigid foam which supports the metal skin and provides a substantial increase in the installation of each door panel. Typically, several panels, such as four elongated panels, are attached together with hinges so that the doors can be raised on tracks having rollers attached to the door panels for guiding and supporting a door when the door is lifted. Typically, the bottom panel has weatherstripping attached thereto for providing a seal between the bottom panel and the floor of the building. Many buildings require large overhead garage type doors for sealing off areas which may be heated or air conditioned and it is desirable to have insulated doors. In the case of metal doors, an insulating material such as wood or a foam polymer material is used in the doors between the front and back piece of sheet metal. However, the sheet metal will conduct heat through the metal skin from the front to the back and leakage can occur where the hinged panels come together when the door is closed. It becomes desirable to shape the edges of connecting panels so as to block the passage of air and to provide weatherstripping to seal between the panels.

The present invention is directed towards providing a better seal between panels while simultaneously providing a means to attach a front and back metal sheet in a spaced relationship to each other to thereby form a non-metallic barrier strip on the edge sides between the front and back metal sheets of each panel. This barrier strip, advantageously, in the present invention also provides a non-adhesive support for weatherstripping.

SUMMARY OF THE INVENTION

A garage door panel has a formed sheet metal skin having a door panel shape and having elongated parallel edges along at least one edge side thereof. An elongated insulating non-metallic barrier strip is attached to each elongated parallel edge on the edge side to hold the edges together in a spaced relationship to act as a barrier strip to the conduction of heat thereacross. The panel has filler material, such as a rigid polyurethane foam, filling the metal skin and an elongated weatherstrip attached to the barrier strip to form a weather seal between one garage door panel and an adjacent panel. The barrier strip member spaces the metal edges of the metal skin of the garage door panel and includes an elongated polymer material having a cross-section shape providing a pair of gripping clips, each positioned to grip one metal edge. Each clip has a plurality of serrations thereon for holding the metal edges of the metal skin of the door panel in a spaced relationship to each other. The barrier strip also has means to support an elongated weatherstrip thereon.

The method of making a garage door panel is provided including the steps of shaping the metal skin for a garage door panel with a pair of elongated parallel edges along one edge side thereof and attaching each of the parallel edges of the metal skin to an elongated barrier strip having clips formed thereon to space and bold the metal edges to said barrier strips and spaced from each other. The shaped metal skin held together by the barrier strip is placed in a frame and a polymer material is injected therein for expanding in the metal skin to form a polymer foam, compressing and supporting the metal skin and compressing against the barrier strip to strengthen the connection between the barrier strip and the metal edges of the metal skin of the garage door panel.

BRIEF DESCRIPTION OF THE DRAWINGS

Other objects, features and advantages of the present invention will be apparent from the written description and the drawings, in which.

DESCRIPTION OF THE PREFERRED EMBODIMENTS

Figure 1:
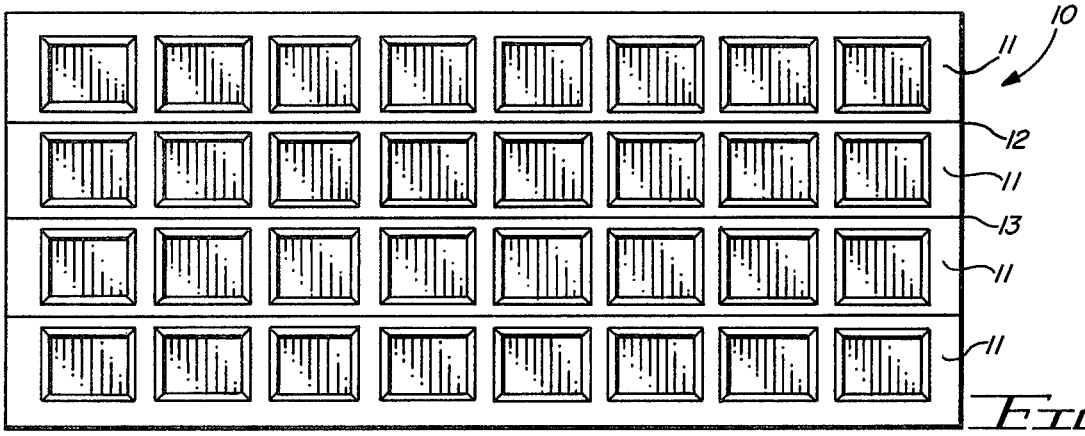
FIG. 1 is a front elevation of a garage door.

Referring to the drawings, FIG. 1 shows a garage door 10 formed with four steel garage door panels 11. Each elongated door panel 11 is formed of a sheet metal skin on the front and back, which are connected along the top edge 12 and along the bottom edge 13 of each panel with a barrier strip to separate the metal on the front side and the metal on the back side. The spacing between the front and back metal sides is filled with a foam polymer such as a rigid polyurethane foam.

Figure 2:
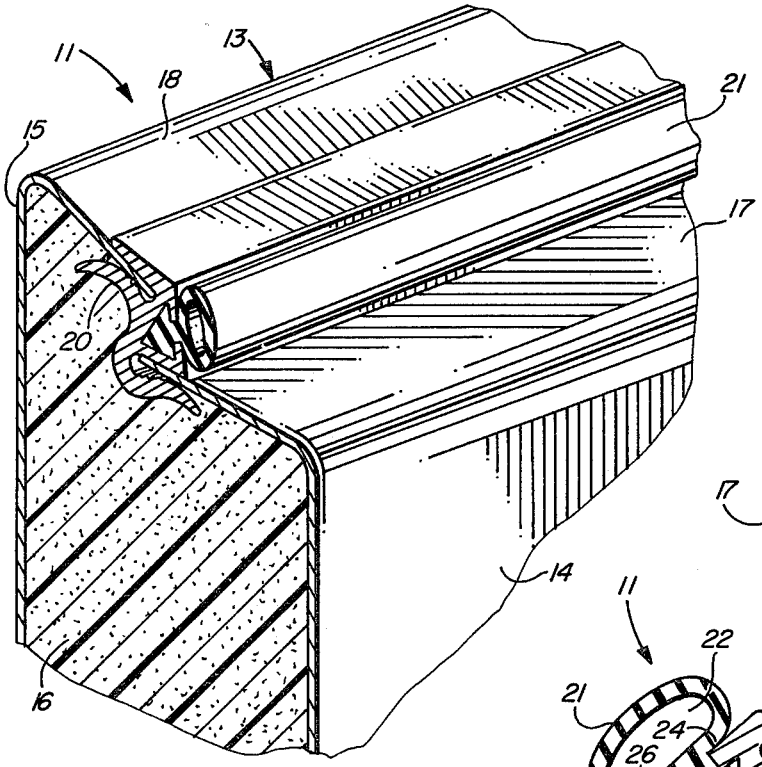
FIG. 2 is a broken away perspective of a portion of a garage door panel having the present barrier strip and weatherstripping installed thereon.
Figure 5:
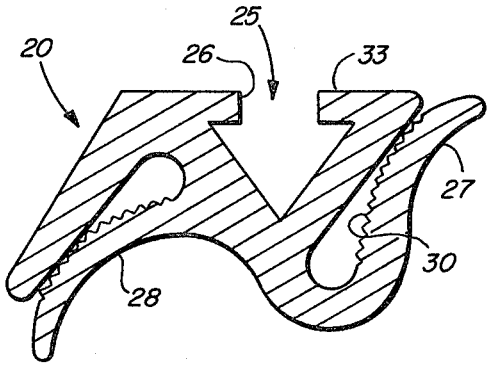
FIG. 5 is a cross-section of the elongated barrier strip of the present invention.

FIG. 2 shows a section of a door panel having the bottom edge 13, an inside metal skin 14 and outside metal skin 15 and filled with a rigid polymer foam 16. The metal skin 15 is bent to form a portion 17 of the edge side 13 while the metal skin 15 is bent to form a secong portion 18 of the edge side 13 of the panel 11. The edges side portions 17 and 18 are connected with a barrier strip 20 and are offset from each other. The barrier strip 20 is made of an insulating material, such as a vinyl or other polymer that prevents the conduction of heat between the metal portions 15 and 18 and the metal portions 14 and 17 and is formed to accept a weatherstrip 21 directly thereon without an adhesive, such as a vinyl weatherstrip. As can be seen, each edge sides 12 and 13 would need a barrier strip 20 so that front and rear metal skins 14 and 15 would be two separate sheets connected by barrier sheets on the top and bottom of the panels, but only one side would need the weatherstrip 21, which will then contact the barrier strip on the next adjacent panel when the garage door 10 is closed, as shown in FIG. 1. It will also be clear from the view in FIG. 2 that the barrier strip 20 offsets the skin portions 17 and 18 so that when the doors are closed adjacent to each other, as more clearly seen in FIG. 4, it not only provides a barrier and a weatherstrip, but the weatherstrip of one barrier strip contact against the adjacent barrier strip, and forms an offset between the door and panels.

Figure 3:
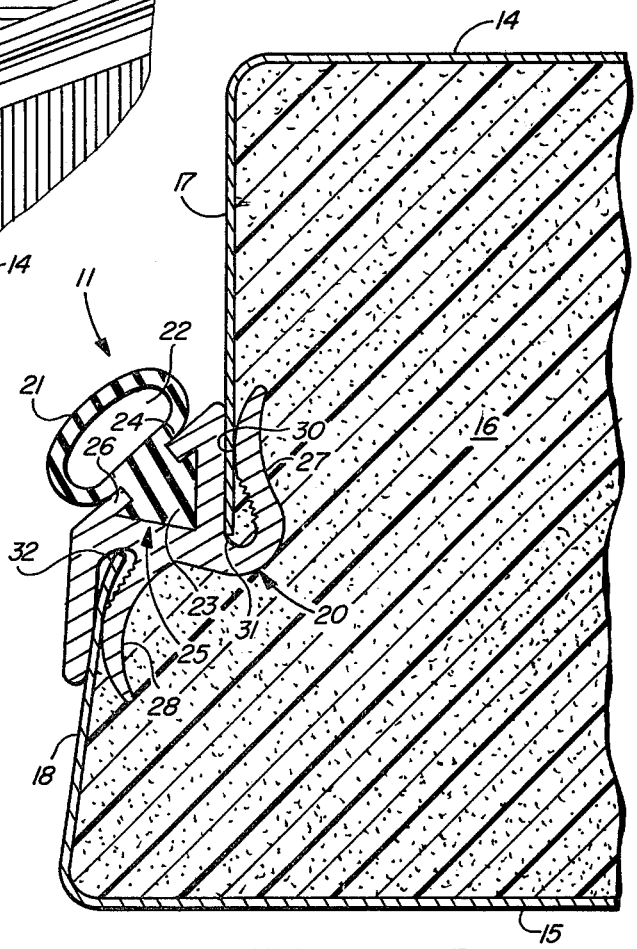
FIG. 3 is a sectional view through one edge of a door panel having a barrier strip and weatherstrip thereon.
Figure 4:
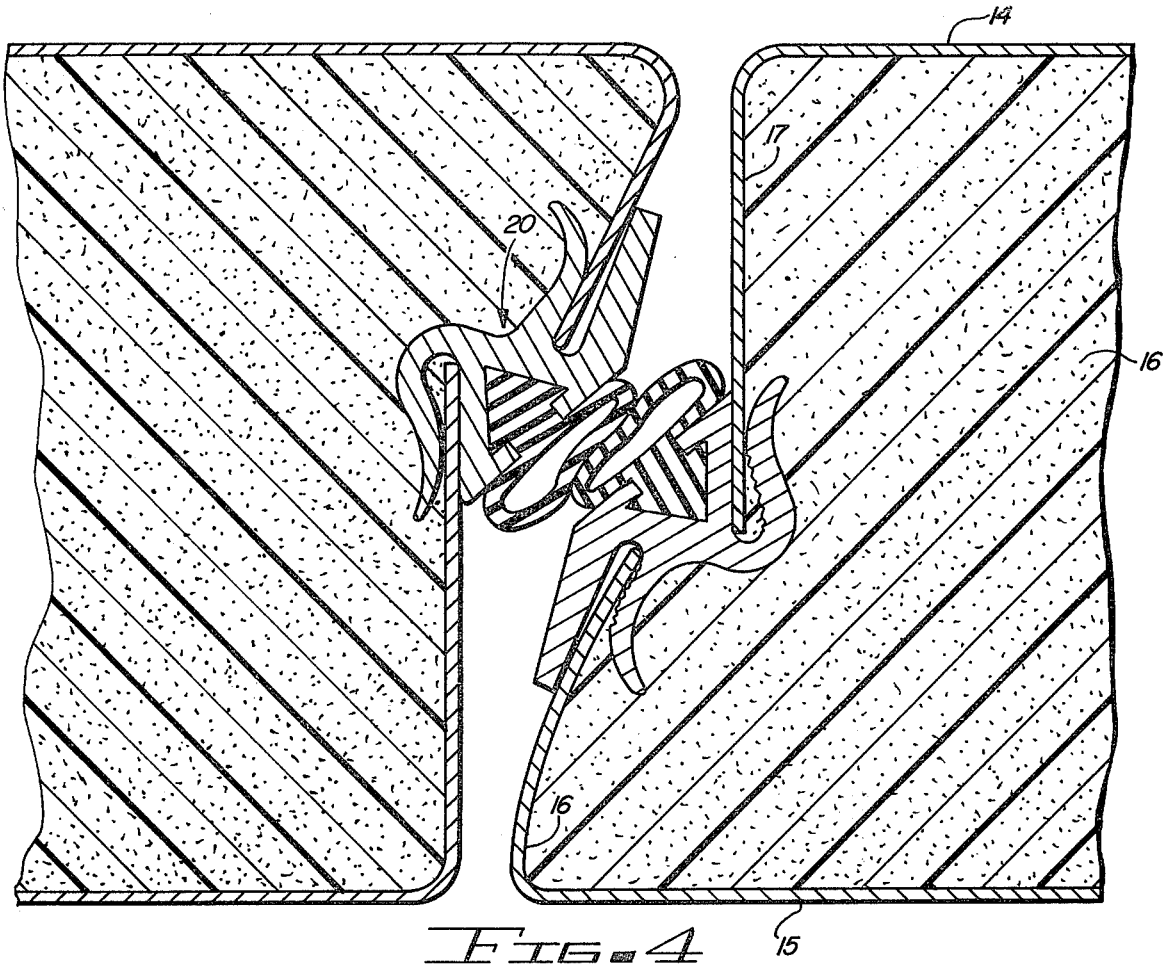
FIG. 4 is a sectional view of a pair of adjacent garage door panels.

In FIG. 3, a sectional view of a door panel 11 has a front skin 15 and a rear skin 14, skin portions 17 and 18, and is filled with a foam polymer 16. The barrier strip 20 has the weatherstripping 21 therein and as can be seen, the final weatherstripping 21 has a hollow passageway 22 therethrough and has a triangular attaching edge 23 connected thereto with a neck portion 24. The barrier strip 20 has a triangular shaped strip 25 which receives the triangular shape 23 through an opening slot 26 in one side of the triangle 25. The barrier strip 20 forms a pair of elongated clips 27 and 28 having serrated edges 30. The inside of the clip portions 27 and 28 are formed with a generally curved surface to allow for the easy insertion of the edge 31 in the clip portion 27 and the edge 32 in the clip portion 28. The edges 31 and 32 may be formed with barbs to engage the serrations 30 to thus lock the metal edges in the barrier strip 20 and to hold it in position until the foam polymer 16 has been injected and expanded, at which time pressure is applied on the clip portions 27 and 28 and along the entire inside of the barrier strip 20 to further lock the back and front panels in positions supported by the barrier strip 20. The clip portions 27 and 28 of the barrier strip 20 are formed similar to standard clips, except in offset positions to provide the necessary offset for the skin portion 17 and 18 of the panels and are formed to position the weatherstrip supporting triangle 25 to position the weatherstrip 21 to press against the surface 33 of the barrier strip 20 or against another piece of weatherstrip 21, as shown in FIG. 4. Surface 33 can help support the weatherstrip on one side and provides a surface for the weatherstrip to seal against on the adjacent door if desired.

Figure 6:
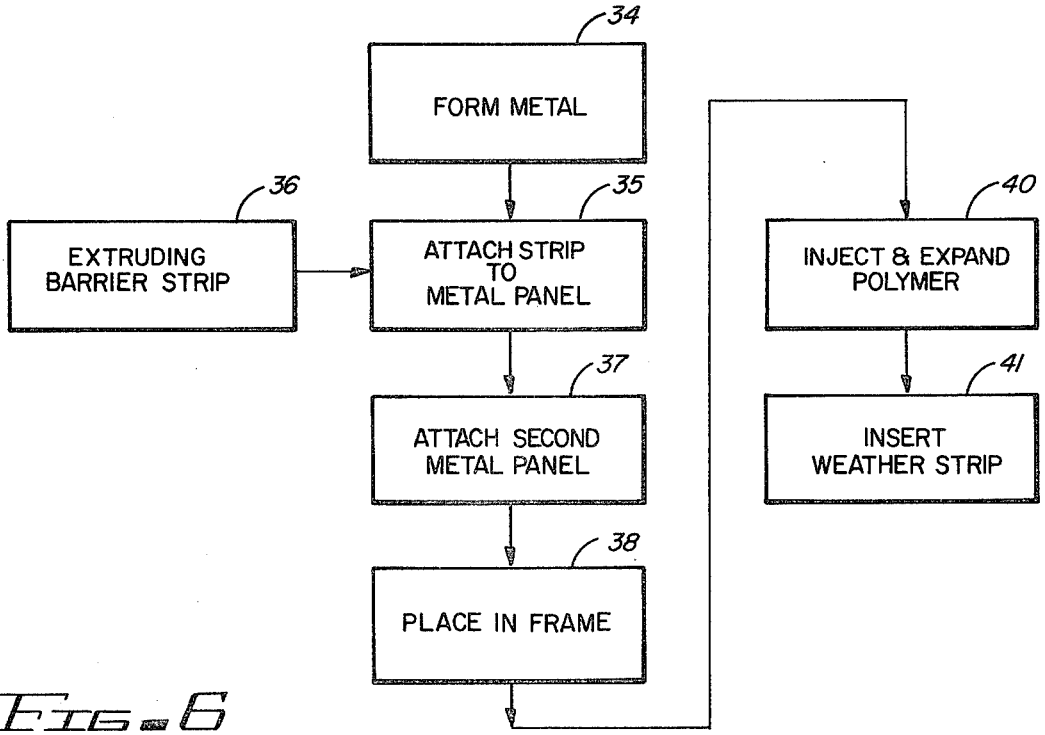
FIG. 6 is a flow diagram of a method of making a door panel in accordance with the present invention.

Turning now to FIG. 6, a flow diagram of a process of making a door in accordance with the present invention is illustrated. The first step is forming (34), the metal skins 14 and 15 having edge sides 17 and 18 with parallel edges 31 and 32. A barrier strip 20 is extruded (36) in a separate step and is cut to size and attached to each of the metal skins 14 and 15 to support and hold the edges 31 and 32 in a spaced relationship to each other. The second panel is attached (37) to the barrier strip and the assembled panel having front and back metal skins held together by top and bottom edge barrier strips are placed in a frame to support the thin metal skins during the injection and expanding of a foamed polymer interior. The door panels are placed (38) into the frame and injected (40) with a foamed polymer material which expands within the assembled metal skins; and finally, the weatherstrip can be inserted (41). The insertion, however, can be accomplished after the entire garage door is assembled, or even on-site if desired, by simply sliding the weatherstrip 21 triangular portion 23 into the triangular portion 25 of the barrier strip. Because of the triangular shape with the open slot, the weatherstrip 21 can be pushed directly through the opening 26.

It should be clear at this time that a garage door panel, as well as a barrier strip for a garage door panel and a method of making a garage door panel have all been provided which acts to lock the front and back metal sheets or skins together to form a metal door panel, while spacing the metal to prevent the conduction of heat therethrough and simultaneously providing either a support for a weatherstrip or a surface for the weatherstrip on one panel to seal against on the next panel. However, the invention is not to be construed as limited to the forms shown, which are to be considered illustrative rather than restrictive.

I claim:

1. A garage door panel comprising in combination:

a metal skin formed to a generally door panel shape and having elongated parallel edges along one edge side thereof;

an elongated, non-metallic barrier strip attached to each elongated parallel edge to hold said parallel edges together and to space said parallel edges from each other;

filler material filling said formed metal skin held together with said elongated barrier strip; and an elongated weatherstrip attached to said barrier strip to form a weather seal between one garage door panel and an adjacent panel, said elongated non-metallic barrier strip being formed of a polymer material having a cross-section shaped to form a pair of gripping clips, each positioned to grip one metal edge for spacing the metal edges from each other, said barrier strip cross-section being shaped to form a hollow triangle having three walls, a slot through one wall thereof having a slot therethrough and having a first clip portion extending generally parallel to a second triangular wall adjacent said second wall to form a clip therewith and a third said triangle wall having a flange and a second clip portion extending at an angle from said third wall barrier strip adjacent to form a second clip therewith.

2. A garage door panel in accordance with claim 1, in which each of said barrier strip gripping clips has a plurality of serrations formed thereon for gripping metal edges of said metal skin.

3. A garage door panel in accordance with claim 2, in which said elongated non-metallic barrier strip hollow triangle walls form an elongated shaped groove therein for attaching said elongated weatherstrip to an elongated flat surface adjacent to the slot in said triangle walls for supporting one edge of said elongated weatherstrip.

4. A barrier strip member for spacing metal edges of a metal skin of a garage door panel comprising in combination:

an elongated polymer material having a cross-section having a pair of gripping clips, each positioned to grip one metal edge for spacing the metal edges from each other and means to support an elongated weatherstrip thereon, said elongated polymer material having a hollow triangle cross-section having three walls and an opening thereinto through one of said walls, said strip further having one of said pair of gripping clips formed by a second triangle wall and a gripping clip portion positioned adjacent and generally parallel thereto, and a second of said pair of gripping clips formed between a flange and a second gripping clip portion which extend at an angle from the third wall, whereby said gripping clips form an integral part of a barrier strip member for spacing metal edges of a metal skin.

5. A barrier strip member in accordance with claim 4, in which each of said pair of gripping clip portions has a serrated surface thereon having a plurality of serrations for gripping the metal skin of a garage door panel.

6. A barrier strip member in accordance with claim 5, in which said means to support an elongated weatherstrip has a flat surface adjacent to the narrowed opening of said grooves therethrough for supporting one edge of said elongated weatherstrip thereon.

7. A barrier strip member in accordance with claim 6, which said elongated polymer material has a cross-section shaped to form a pair of gripping clips spaced to position each metal edge in an offset position from the other metal edge.

* * * * *